United States Patent [19]

Hasenfuss et al.

[11] Patent Number: 4,720,052

[45] Date of Patent: Jan. 19, 1988

[54] DEVICE FOR THE FASTENING OF HAMMERS IN REBOUND-MILL ROTORS

[75] Inventors: Stefan Hasenfuss; Bernd Kirchhoff, both of Ennigerloh, Fed. Rep. of Germany

[73] Assignee: O&K Orenstein & Koppel Aktiengesellschaft, Dortmund, Fed. Rep. of Germany

[21] Appl. No.: 867,649

[22] Filed: May 28, 1986

[30] Foreign Application Priority Data

Jun. 15, 1985 [DE] Fed. Rep. of Germany ..... 3521588

[51] Int. Cl.[4] ..... B02C 13/26

[52] U.S. Cl. ..... 241/192; 241/286

[58] Field of Search ..... 241/185 R, 191, 192, 241/195, 286

[56] References Cited

U.S. PATENT DOCUMENTS 2,747,803 5/1956 Hanse ..... 241/191

3,784,117 1/1974 Koenig et al. ..... 241/195

FOREIGN PATENT DOCUMENTS 2148752 4/1973 Fed. Rep. of Germany .

2850299 5/1980 Fed. Rep. of Germany .

*Primary Examiner*—Timothy V. Eley

*Attorney, Agent, or Firm*—Martin A. Farber

[57] ABSTRACT

A device for the fastening of hammers in axially extending cutouts of rebound-mill rotors having a form-locked attachment between each hammer and one side of the corresponding cutout and a force-locked attachment on the other side by means of at least one wedge-shaped clamping ledge which can be acted on in clamping direction by a plurality of pressure elements each of which has a clamping piston acted on by a pressure medium and which are connected to each other by a common pressure conduit which can be closed by a valve. The clamping pistons are arranged in the clamping ledge and are connected by the pressure conduit which debouches in at least one end surface of the clamping ledge and is filled with a flowable, plastic, compressible pressure medium which, in order to obtain excess pressure, can be acted on by a setting piston which is developed on a closure screw which can be screwed into the mouth of the pressure conduit.

3 Claims, 4 Drawing Figures

DEVICE FOR THE FASTENING OF HAMMERS IN REBOUND-MILL ROTORS

FIELD AND BACKGROUND OF THE INVENTION

The present invention concerns a device for fastening hammers in axially extending recesses of rebound-mill rotors with a form-locked connection between each hammer and one side of the corresponding recess and a force-locked connection on the other side by means of at least one wedge-shaped clamping strip which is acted on in the direction of clamping by a plurality of pressing elements each of which has a clamping piston acted on by a pressure medium, they being connected to each other by a common pressure line which can be closed by a valve.

A device of the type described above for the fastening of hammers in rebound-mill rotors is already known. The clamping pistons which are provided instead of mechanical clamping elements are arranged in the bottom of the axially extending recesses in the rebound-mill rotor and connected to each other by a common pressure conduit which is developed in the rotor and is filled with a hydraulic fluid. After the insertion of the hammers and clamping ledges the pressure conduit is filled with hydraulic fluid. As a result, the piston rods of the clamping pistons travel upward and displace the clamping ledge. By the application of a predetermined excess pressure in the hydraulic fluid assurance is to be provided that a sufficient additional clamping action is always available.

The known device has the disadvantage that as the result of the use of a non-compressible hydraulic fluid as pressure medium, the pressure which has built up in the hydraulic system suddenly collapses upon the occurrence of slight leakage losses or upon a jigging of the hammers or clamping ledges so that the clamping pistons which act on the clamping ledge cannot by themselves assure a dependable attachment of the hammers. In practice therefore, in the case of the known devices, retensioning springs for the clamping pistons are provided and a mechanical fixing of the clamping ledge present in the clamping position by means of nuts or bolts is effected. In this way, the known device is not only structurally expensive but it is also cumbersome to handle, since after the clamping position is reached each clamping ledge must be individually secured by the hydraulic system.

The object of the present invention is so to improve a device of the afore mentioned type that, while retaining the clamping pistons, the use of retensioning springs and in particular of mechanical locking elements can be dispensed with and a particularlly simple construction created which avoids expensive and weakening machining of the rebound-mill rotor.

SUMMARY OF THE INVENTION

This object is achieved by the invention in the manner that the clamping pistons are arranged in the clamping ledge and are connected by the pressure conduit which discharges into at least one end surface of the clamping ledge, the conduit being filled with a flowable, plastic and compressible pressure medium which can be acted on, in order to obtain an excess pressure, by a setting piston which is developed on a closure screw which can be screwed into the mouth of the pressure conduit.

The plastic medium, which due to its flowability can be introduced without problem into the common pressure conduit and into the piston chambers of the clamping pistons, makes the provision of mechanical or hydraulic spring storage means dispensable in view of its compressibility. As a result of the compressibility jigging phenomena, i.e. increases in the play of the hammers and clamping ledges, are automatically compensated for without the system losing pressure. The merely slight flowability of the medium furthermore avoids leakage losses so that the clamping pistons alone can be used both for transferring the clamping ledge into the clamping position and for maintaining this clamping position.

By the arrangement of the clamping pistons in the clamping ledge the possibility is created of retrofitting existing rebound mills for the system in accordance with the invention without acting on the rebound-mill rotors. Maintenance and possibly repair are also limited to the replacement of the clamping ledges. Since the elastomer is resistant to aging and non-hygroscopic, the device of the invention can be used at temperatures between $-15°$ and $+80°$ C., so that there are no limitations on the use of the device of the invention with respect to temperature either.

Finally, the displacement member for the obtaining of excess pressure is developed as setting piston the cylinder space of which is in communication with the pressure conduit. By axial displacement of the setting piston the specific desired pressure can thus be built up in the system. The pressure conduit debouches in at least one end surface of the clamping ledge so that there is not only simple access for the filling of the system but, in addition, there is the possibility of placing the system under pressure by simple means as soon as the hammers and clamping ledges are installed. In the simplest embodiment, the setting piston is developed on a closure screw which can be screwed into the mouth of the pressure conduit. By the tightening of the closure screw a desired increase in pressure is thus simultaneously obtained.

In a preferred embodiment of the invention, a filling opening which can be closed by a non-return valve is developed in the closure screw so as to result in a particularly simple construction for the filling and closing of the pressure conduit and for the increase in pressure.

BRIEF DESCRIPTION OF THE DRAWINGS

With the above and other objects and advantages in view, the present invention will become more clearly understood in connection with the detailed description of a preferred embodiment, when considered with the accompanying drawings, of which.

DETAILED DESCRIPTION OF THE PREFERRED EMBODIMENT

Figure 1:
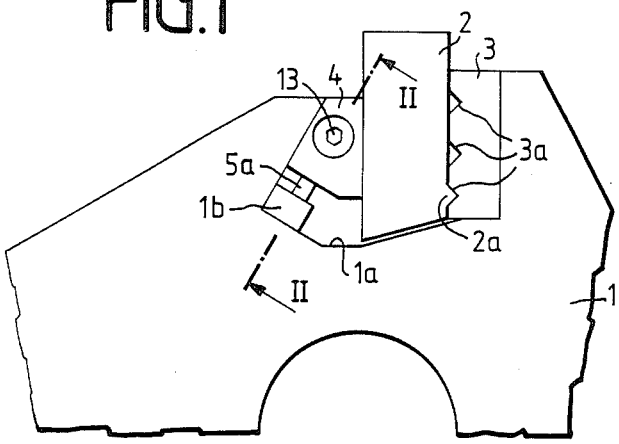
FIG. 1 is an end view of a part of a rebound-mill rotor.

The rebound-mill rotor 1 which is mounted for rotation in a rebound mill (not shown), a partial view of which rotor is given in FIG. 1, has in its periphery a plurality of axially extending cutouts 1*a*, each of which serves to receive a hammer 2. This hammer 2 is fixed in position in each case on one side via a form-locked attachment to the rebound-mill rotor 1. In the embodiment shown in FIG. 1, this is done by means of a holding strip 3 which is fastened in the cutout 1*a* of the rebound-mill rotor 1 and has a plurality of grooves 3*a*. A projection 2*a* of the hammer 2 engages into one of said grooves 3*a*, said projection being either formed on the hammer 2 itself or—as in the case of the embodiment shown—by a spring of circular cross section which is inserted into a corresponding groove in the hammer 2. In this way it is possible to displace the hammer 2, upon wear, in radial direction relative to the rebound-mill rotor 1.

On the side opposite the holding ledge 3, each hammer 2 is held fast in force-locked manner by means of a wedge-shaped clamping ledge 4. This clamping ledge 4 has one surface lying against the surface of the hammer 2 and the other surface, which extends at an acute angle, lying against a side wall of the cutout 1*a* of the rebound-mill rotor 1, as can best be noted from FIG. 1. The clamping ledge 4 can extend over the entire axial length of the rebound-mill rotor 1. Instead of a continuous clamping ledge 4, two separate clamping ledges can also be used.

Figure 2:
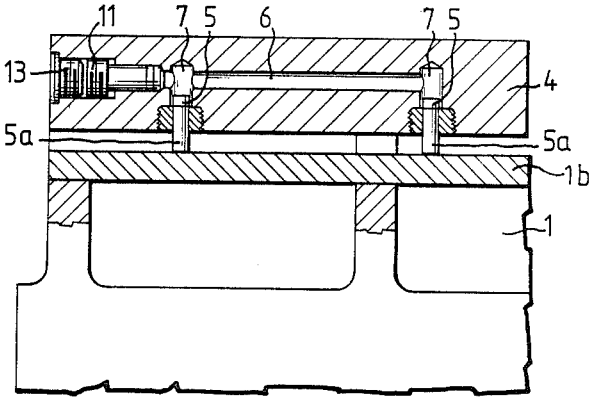
FIG. 2 is a longitudinal section along the section line II—II of FIG. 1.

The wedge-shaped clamping ledge 4 is acted on in the direction of clamping by several pressure elements which, in the embodiment shown, are arranged in the clamping ledge 4 and in each case surround a clamping piston 5 whose piston rod 5*a* extends out of the bottom of the clamping ledge 4 in sealed fashion and rests in the bottom of the cutout 1*a* of the rebound-mill rotor 1. In the embodiment shown in FIGS. 1 and 2, a pressure ledge 1b is arranged in the bottom of the cutout 1*a* to support the piston rods 5*a* of all clamping pistons 5.

Figure 3:
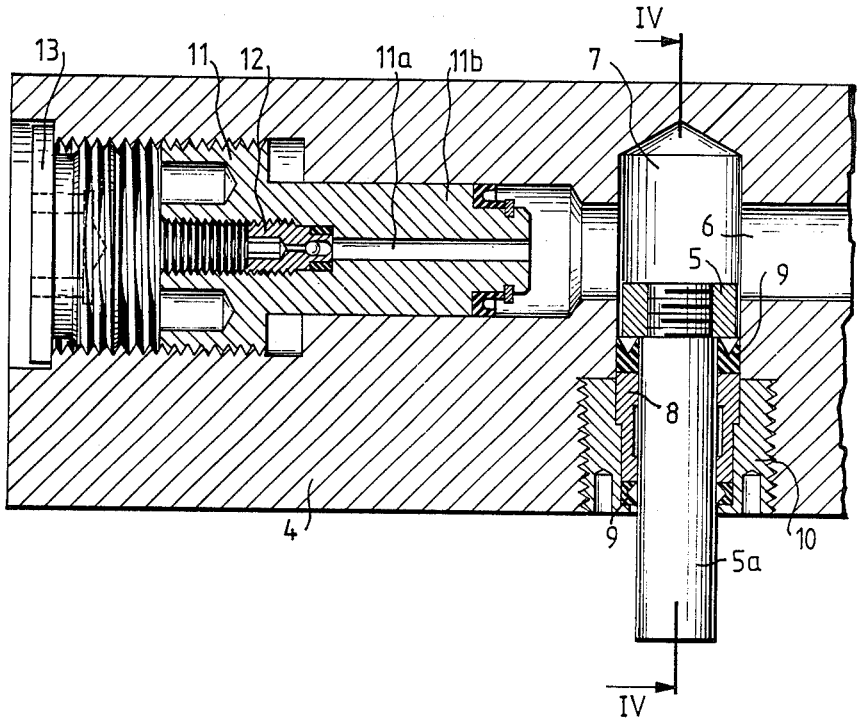
FIG. 3 is an enlarged showing of a part of FIG. 2.
Figure 4:
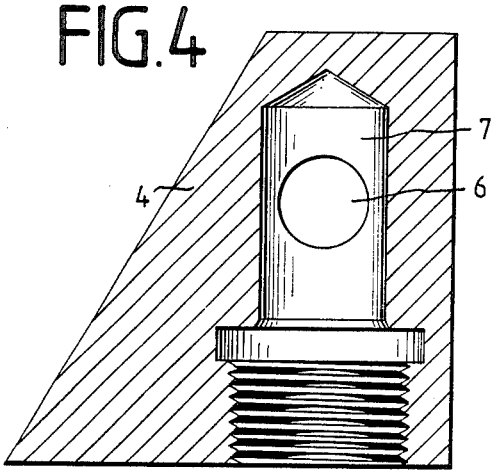
FIG. 4 is a cross section along the section line IV—IV of FIG. 3.

As can be noted in particular from FIGS. 3 and 4, the clamping ledge 4 contains a pressure conduit 6 in the form of a bore which extends practically over the entire axial length of the clamping ledge and connects the cylinder spaces 7 for the clamping pistons 5 to each other. These clamping pistons 5 are formed, in the embodiment shown in FIG. 3, by annular disks which are screwed onto the cylindrical piston rods 5*a*. The piston rods 5*a* are conducted through separate bushings 8 and sealed by seals 9. The bushings 8 are inserted into the clamping ledge 4 by a screwable mounting part 10. The clamping piston 5 as well as the bushin 8 and the mounting part 10 have been omitted in FIG. 4.

The pressure conduit 6 debouches in an end surface of the clamping strip 4 and can be closed by a closure screw 11. This closure screw 11, which is developed in the form of a stud screw, has a continuous filling opening 11*a* within which an insert 12 having a non-return valve is arranged. In this way it is possible to fill the pressure conduit 6 as well as the cylinder spaces 7 of the clamping pistons 5 with a pressure medium.

As pressure medium there is used a flowable, plastic compressible medium, preferably an elastomer. This elastomer is of slight flowability so that leakage losses need not be feared even in the rough everyday operation of the rebound-mill rotor. After the installation of hammer 2 and clamping ledge 4, the elastomer is forced through the filling opening 11*a* of the closure screw 11 into the pressure conduit 6 so that, by the clamping pistons 5, their piston rods 5*a* are extended until they come to rest against the pressure ledge 1*b*. The compressible pressure medium is now placed under pressure by means of a displacement member so as to obtain a pressure-regulating effect, in the manner of an accumulator, in the entire system. In the embodiment shown, the displacement member is formed by a setting piston 11*b* which is integral with the closure screw 11 and is displaced axially within the pressure conduit 6 by turning the closure screw 11. In this way, the specific excess pressure desired can be obtained in the elastomer by turning the pressure screw 11 to a greater or lesser extent.

By means of this excess pressure and the compressibility of the elastomer there is obtained a securing of the position of the clamping ledge 4 even in the event that, upon the operation of the rebound-mill rotor, the hammer 2 or the parts securing said hammer 2 in the cutout 1*a*, namely the holding ledge 3 or the clamping ledge 4, should shift. Even in the event of slight leakage losses, the excess pressure present in the elastomer is sufficient to hold the clamping ledge 4 in its clamping position and thus secure the hammer 2 against being thrown out. Additional spring elements or mechanical securing means are thus unnecessary.

For the replacement of the hammer 2, the closure screw 11 is turned back until the piston rods 5*a* of the clamping pistons 5 can be pushed back into the interior of the clamping ledge 4 so that the latter can then be pulled axially out of the cutout 1*a* in the rebound-mill rotor 1. If necessary, a certain part of the plastic, compressible medium can also be let out of the pressure conduit 6 via the filling opening 11*a* of the closure screw 11. In order to prevent undesired displacement of the closure screw 11, the threaded bore of the clamping ledge 4 which receives the closure screw 1 is closed by a plug 13 in the embodiment shown.

We claim:

1. In a device for fastening hammers in axially extending cutouts in a rebound-mill rotor having a form-locking attachment between each hammer and one side of the corresponding cutout and aa force attachment on the other side by means of at least one wedge-shaped clamping ledge which is acted on in the clamping direction by a plurality of pressure elements each of which has a clamping piston acted on by a pressure medium and which are connected to each other by a commpressure conduit which can be closed by a valve, the improvement wherein said clamping pistons are arranged in the clamping ledge and are connected by the pressure conduit, the latter opening in at least one end surface of the clamping ledge and being filled with a flowable, plastic compressible pressure medium, a closure screw being screwable into a mouth of the pressure conduit, and a setting piston being formed on said closure screw acting on said pressure medium for obtaining an excess pressure.

2. The device according to claim 1, wherein said closure screw is formed with a filling opening, means comprising a check valve for enabling closing of said filling opening.

3. The devicee according to claim 1, wherein said at least one end surface is adjacent an end of the rebound-mill rotor and substantially planar with respect to said end surface of the rebound-mill rotor, and said mouth is located at said end surface.

* * * * *